US009560905B2

(12) United States Patent
Cordoba Ramos

(10) Patent No.: US 9,560,905 B2
(45) Date of Patent: Feb. 7, 2017

(54) DEVICE AND METHOD FOR SELECTIVELY BLEACHING OR DYEING A PLURALITY OF LOCKS OF HAIR

(71) Applicant: MULTIMECHAS, S.L., Marbella (ES)

(72) Inventor: Rafael Cordoba Ramos, Marbella (ES)

(73) Assignee: MULTIMECHAS, S.L., Marbella (ES)

( * ) Notice: Subject to any disclaimer, the term of this patent is extended or adjusted under 35 U.S.C. 154(b) by 84 days.

(21) Appl. No.: 14/394,680

(22) PCT Filed: Apr. 15, 2013

(86) PCT No.: PCT/ES2013/070238

§ 371 (c)(1),
(2) Date: Oct. 15, 2014

(87) PCT Pub. No.: WO2013/156648

PCT Pub. Date: Oct. 24, 2013

(65) Prior Publication Data

US 2015/0096583 A1 Apr. 9, 2015

(30) Foreign Application Priority Data

Apr. 16, 2012 (ES) ..... 201230561

(51) Int. Cl.
*A45D 19/18* (2006.01)
*A45D 19/00* (2006.01)
*A45D 24/02* (2006.01)

(52) U.S. Cl.
CPC ..... *A45D 19/0008* (2013.01); *A45D 19/0025* (2013.01); *A45D 24/02* (2013.01);
(Continued)

(58) Field of Classification Search
CPC ..... A45D 19/0008; A45D 19/0016; A45D 19/0025; A45D 19/0033; A45D 19/0066; A45D 19/0091; A45D 19/0075; A45D 19/0083; A45D 19/18; A45D 2019/0075; A45D 2019/0066; A45D 2019/0091; A61Q 5/08; A61Q 5/10
See application file for complete search history.

(56) References Cited

U.S. PATENT DOCUMENTS 1,550,930 A * 8/1925 Sullivan ..... A45D 19/0008 132/212
2,041,641 A * 5/1936 Santi Grasso ..... A45D 7/045 132/211
(Continued)

FOREIGN PATENT DOCUMENTS

DE 81 25 011 U1 12/1981
DE 102 61 242 A1 7/2004
(Continued)

OTHER PUBLICATIONS

International Search Report for PCT/ES2013/070238 dated Aug. 13, 2013.

*Primary Examiner* — Robyn Doan
(74) *Attorney, Agent, or Firm* — Sughrue Mion, PLLC

(57) ABSTRACT

The present invention relates to a device and method for selectively bleaching or dyeing a plurality of locks of hair. The device basically comprises a selector comb for selecting the locks to be treated from a portion of hair, and a container provided with at least one compartment that can internally house at least one liquid or pasty product for dyeing or bleaching. The selector comb is partially introduced inside the container and is movable inside and along same, being coupled thereto such that in an operating position of the device, the movement of the comb takes place, causing the gradual introduction of an increasingly longer portion of the locks selected by the comb inside the container at the same time as the gradual opening and communication of the inside of the compartment with the portion of the locks introduced
(Continued)

therein, said portion being exposed to the liquid or pasty product.

15 Claims, 10 Drawing Sheets

(52) U.S. Cl.
CPC ..... *A45D 2019/0066* (2013.01); *A45D 2019/0075* (2013.01)

(56) References Cited

U.S. PATENT DOCUMENTS 2,655,924 A * 10/1953 Petitta ..... A45D 7/04 132/212
3,255,765 A * 6/1966 Sturdivant ..... A45D 2/127 132/223
3,543,771 A * 12/1970 Altman ..... A45D 2/127 132/222
3,692,032 A * 9/1972 Regas ..... A45D 19/0025 132/212
4,637,411 A * 1/1987 Sanders ..... A45D 19/0025 132/212
5,584,309 A * 12/1996 De Beneditis ..... A45D 7/04 132/208
5,771,906 A * 6/1998 De Benedictis ..... A45D 2/00 132/207
5,931,168 A * 8/1999 Abercrombie ..... A45D 19/0025 132/208
6,035,862 A * 3/2000 Di Luca ..... A45D 19/0008 132/270
6,112,751 A 9/2000 Bennett
7,198,049 B2 * 4/2007 Elmer ..... A45D 19/0008 132/208
7,770,586 B2 * 8/2010 Tojo ..... A45D 2/20 132/222
8,132,575 B2 * 3/2012 Tojo ..... A45D 19/0008 132/270
2004/0216759 A1 11/2004 Elmer et al.
2004/0231689 A1 * 11/2004 Kobayashi ..... A45D 2/08 132/222
2006/0157078 A1 * 7/2006 Tojo ..... A45D 19/0025 132/222
2008/0087292 A1 4/2008 Abergel et al.
2009/0056738 A1 * 3/2009 Tojo ..... A45D 2/122 132/270

FOREIGN PATENT DOCUMENTS

ES 2 171 914 T3 9/2002
WO 92/14379 A1 9/1992

* cited by examiner

DEVICE AND METHOD FOR SELECTIVELY BLEACHING OR DYEING A PLURALITY OF LOCKS OF HAIR

CROSS REFERENCE TO RELATED APPLICATIONS

This application is a National Stage of International Application No. PCT/ES2013/070238 filed Apr. 15, 2013, claiming priority based on Spanish Patent Application No. P 201230561 filed Apr. 16, 2012, the contents of all of which are incorporated herein by reference in their entirety.

TECHNICAL FIELD OF THE INVENTION

The present invention relates to a device for applying highlights in hair, i.e., for selectively bleaching or dyeing a plurality of locks of hair by means of applying at least one liquid or pasty product. The device comprises a selector comb for selecting the locks to be bleached or dyed from a portion of hair, and a container provided with at least one compartment suitable for internally housing the liquid or pasty product or products to be distributed on the selected locks of hair. According to other aspects of the invention, a method for dyeing, bleaching and applying highlights in hair using the aforementioned device, as well as a supply for refilling the device with the liquid or pasty product are also disclosed.

BACKGROUND OF THE INVENTION

Applying highlights in hair is one of the most common hairstyling salon practices when one wants to liven up or enhance one's hair, emphasizing a certain color with respect to another to make it more interesting and attractive. It basically consists of applying bleach or dye directly to the hair distributed in locks spread out in the desired region to give the desired enhancement or color.

It is generally appropriate to dye or bleach only the locks of hair on the outermost layer which are the ones that are seen. Nevertheless, the liquid dye or bleach tends to penetrate all the hair, so it is not uncommon for it to reach the underlying hair that is not meant to be treated.

Therefore, even though this practice may in principle seem simple, professional hairstylists and others who have tried to give someone else or themselves highlights admit that it is necessary to be extremely familiar with the technique in order to obtain a truly professional result.

The three most well-known techniques for applying hair highlights are: comb-in highlights, cap highlights and foil highlights. The choice of one technique or another depends on the desired highlight thickness, highlight distribution and hair length, and each one has its own advantages and drawbacks.

Comb-in highlights are used for very fine and superficial highlights. To that end, dye or highlighting liquid is usually applied to the tip of a comb that is subsequently passed through several locks, one at a time, and time is given to the liquid to act before the hair is washed again. With this method it is not feasible to make too many highlights because when the individual locks are covered with liquid, it is easy for part of that liquid to be transferred to portions of adjacent hair that one does not want to dye or bleach.

To facilitate the task of applying comb-in highlights, several tools have emerged, such as that disclosed in utility model ES103272-U, which describes a device for distributing dye and a tool combined for applying highlights in the hair, which a hairstylist forms by making locks of hair according to different layers. The device comprises a body for distributing dye and a tool combined with the first for applying highlights.

Another example of a device is the one disclosed in patent ES2171914-T3, consisting of a comb comprising a rod from one of the sides of which there extends a plurality of parallel prongs, wherein the rod is hollow and communicated with a reservoir for a viscous liquid to be applied to the hair, and fluid-containing little wells which are laterally open on only one side, each one in the junction between two prongs. Each fluid-containing little well is defined by a hole in the rod to which fluid is supplied from the rod of the comb. The prongs of the comb are separated to provide a plurality of wider spacings at their distal ends and narrower spacings at their root ends, the wider spacings being able to receive the locks to be treated, each narrower spacing communicating with a fluid-containing little well.

In the cap highlights, the hair is usually brushed from front to back before placing a plastic cap provided with a series of small holes uniformly distributed all over its surface and the cap is tied under the chin to fix it to the head. The hairstylist introduces a crochet needle through each hole to hook a lock of hair and pull it out through the hole. The highlights will be more or less chunky depending on the amount of hair that is hooked. The locks of hair pulled out in this manner and isolated from the rest of the hair remaining under the cap are then subjected to treatment with bleach or dye, and the product is left to act so that the color change effect takes place. After a suitable period of time, according to the desired highlight tonality, the cap is taken off and the entire head is washed to remove the bleach. The bleaching or lightening, whichever is appropriate, is completed by adding a pigment.

Since in this technique the hair must first be brushed from front to back, there is a considerable amount of hair under the cap that keeps the cap separated from the scalp and makes it difficult for the treatment to reach the hair roots, there being several millimeters that go untreated and therefore given an unkempt result. On the other hand, the hair underlying the hair that is on top can be from a different area of the head, and added to the fact that the hairstylist cannot see through the cap, it is difficult to control exactly what part of the hair is being subjected to treatment. Another drawback to be taken into account is that vast experience and care are required for introducing the crochet needle without hurting the scalp, and in the regions surrounding the ears, which are also are covered by the cap and hidden from the view of the hairstylist, in addition to the discomfort and even certain pain caused in the person when the cap is removed after the treatment time has elapsed.

The foil technique consists of maintaining a strip of aluminum foil under the hair to be subjected to treatment. Firstly, a portion of hair to be treated or dyed is separated from the rest and combed, and it is worked by known techniques, for example successively moving a crochet needle or a tool with a fine and elongated end up and down for the purpose of selecting the fine locks left above the passage of the needle and these will be the locks that are subjected to treatment. The plurality of fine locks selected from the chosen portion is tensed with one hand, and a strip of aluminum foil is held thereunder against the scalp, making sure that the edge of the strip is as close as possible to the roots of the selected locks. Then the bleach, dye or other product suitable for changing hair color is applied with a brush to the plurality of locks isolated in this manner and placed on the strip of foil. After that, the free lower end of the strip of aluminum foil is folded or rolled towards the head until it is separated from the next portion of hair that has to be subjected to treatment. The sides of the strip are also folded inwards to form a wrapper or packet completely enclosing the locks subjected to treatment, leaving them like that for the necessary time, and the wrapper is removed after that.

Placing and keeping the strip of foil or wrapper in its place both while applying the bleaching or dyeing agent during the process of action of said agent is not easy and is extremely tedious. Any movement of the head of the person being subjected to treatment or any carelessness on the part of the hairstylist can lead to splashes or the formation of dotting or bleaching in unwanted regions. Furthermore, it is not simple when the person with the many wrappers in his/her head is placed under a dryer to accelerate the bleaching process because any movement can make one or some of the wrappers slide out of their position and ruin the desired effect. Another drawback is that since the locks are wrapped in foil, the hairstylist has to partially undo the wrapper to check the degree of bleaching acquired during the wait time. As indicated, the process is long and tedious and uniformity of all the highlights is not assured because the hairstylist is usually more tired with the last applications and will most likely unwittingly vary the thickness of the highlights when working the hair prior to applying the product.

It would therefore be desirable to have a device that allowed applying highlights in hair in a simple and quick manner, achieving a satisfactory result regardless of the hairstylist's skill.

DISCLOSURE OF THE INVENTION

For the purpose of providing a solution to the problems considered, a device for selectively bleaching or dyeing a plurality of locks of hair by means of applying at least one liquid or pasty product is disclosed. The device object of the invention comprises a selector comb for selecting the locks to be bleached or dyed from a portion of hair, and a container provided with at least one compartment that can internally house the liquid or pasty product.

The device for bleaching or dyeing is essentially characterized in that the selector comb is partially introduced inside the container and is movable inside and along the same, the comb being coupled to the container such that in an operating position of the device, the movement of the selector comb takes place, which causes the gradual introduction of an increasingly longer portion of the locks selected by the comb inside the container at the same time as the gradual opening and communication of the inside of the compartment with the portion of the locks introduced inside the container, said portion being exposed to the liquid or pasty product or products.

According to a feature of the invention, the container has a flattened structure which in a non-operating position of the device is arranged folded in half with respect to its total length, a portion equivalent to half the total length of the actual structure being introduced in the structure itself, the container in said non-operating position forming a body comprising at least one double wall formed by an outer wall and by an inner wall, and a central space, demarcated by the inner wall, in which the selector comb is partially introduced, said body being provided with at least one compartment formed by the space demarcated between the outer wall, the inner wall and the joint section of these walls at one of the ends of the body coinciding with the section of the fold of the flattened structure. In an operating position of the device, the inner wall of the body is dragged by the selector comb towards the fold of the flattened structure, causing the movement and shortening of said inner wall with respect to the outer wall, and hence the unfolding of the flattened structure up to an end operating position in which the flattened structure is completely unfolded and provided with a single wall of a length equivalent to the length of the outer wall plus the length of the inner wall in the non-operating position.

According to a first embodiment of the device, the container has a flattened tubular sleeve structure which in a non-operating position of the device is arranged folded in half with respect to its total length, a portion of the sleeve itself of a length equivalent to half the total length the sleeve would have if it were unfolded being introduced inside the cavity of the tubular case in a folded state, the container in said non-operating position forming a double-walled hollow tubular body formed by an outer wall and by an inner wall joined by one of the two ends thereof by means of the fold of the tubular sleeve, the inner wall being what forms the central space and the other end of said inner wall, opposite the fold, being coupled to the selector comb. In the operating position of the device, the unfolding of the tubular sleeve takes place up to an end operating position in which the case is completely unfolded and provided with a single surrounding wall of a length equivalent to the sum of the lengths of outer wall and of the wall, and with the central space limited by said surrounding wall.

According to a second embodiment of the device, which in fact is the preferred embodiment, in a non-operating position of the device the container comprises two compartments having a flattened structure, coupled to the selector comb and arranged symmetrically with respect thereto, and a central space existing between the two compartments in which the comb is arranged partially introduced, in which each compartment is formed by a folded portion having a laminar structure such that each compartment is formed by an outer wall and an inner wall facing one another and joined by one of the two ends thereof by means of the fold, the two inner walls being what form the central space, and the other end of each inner wall, opposite the fold, being coupled to the selector comb. In an operating position of the device the unfolding of the laminar portion of each compartment takes place up to an end operating position in which each laminar portion is completely unfolded and the container is formed by two walls, each of a length equivalent to the sum of the lengths of the outer wall and of the inner wall, and by the central space comprised between said two walls.

According to another feature of the invention, at least one compartment comprises at least one liquid or pasty product for dyeing or bleaching hair in the space formed between the outer wall, the inner wall and the joint section of these walls along the fold. Said space of the compartment will preferably already be provided with the product, so the user can dispose of same like consumable fillers for each use. The compartments are impregnated with or have a small amount of product, like a brushstroke or a thin layer thereof.

According to the second embodiment of the device, each compartment comprises in the space formed between the outer wall, the inner wall and the fold, a different liquid or pasty product which reacts when contacted with the product of the other compartment, causing the dyeing or bleaching of the locks selected by the comb inside the container. Again, as mentioned above, a brushstroke of product or an impregnation thereof in the compartment will be a sufficient amount for dyeing or bleaching.

According to another feature of the invention, the selector comb comprises a head formed by an essentially flat portion and provided at its free end with a set of teeth shaped like prongs and hooks, followed by a handle-like elongated part so that a user can pull on the elongated part to go from the non-operating position to an operating position of the device. The head of the selector comb has about the same width as the container, so said head is suitable for being introduced in the flattened structure forming the container. Optionally, the handle of the comb can also have a width similar to the width of the container.

According to another feature of the invention, in the non-operating position of the device, the essentially flat portion of the head of the selector comb comprises an attachment region extending along the width of the head and arranged a certain distance from the free end provided with the set of teeth, whereby the comb is coupled to the end of each inner wall, opposite the fold of the container, the comb being arranged partially inside the cavity or central space of the container with at least the exception of the free end of the head provided with the set of teeth, which projects from one end of the container in the non-operating position of the device. In contrast, in the operating position of the device, including the end operating position, the free end of the head is located inside the central space of the container.

According to the second embodiment of the device, the inner wall of each compartment is provided with an adhesive strip at its end opposite the fold, whereby the compartment is removably coupled and attached to the selector comb.

According to another feature of the invention, the device of the invention comprises sealing and holding means coupled to the container, provided with two jaws suitable for the leak-tight closure of the end of the container opposite the fold or folds and suitable for removably fixing the device to a region of the portion of hair containing the locks, said region being located adjacent to the scalp. Furthermore, in the non-operating position of the device, the set of teeth of the free end of the head of the comb is located on the outside of the two jaws.

According to another feature of the invention, the sealing and holding means comprise closure means for the facing arrangement of the two jaws, the distal ends of the jaws facing one another and being configured for firmly grasping a region of the hair close to the scalp or any other element interposed between the two jaws, while at the same time providing the leak-tight closure for the end of the container opposite the fold.

According to another feature of the invention, the outer wall of each compartment is provided with an adhesive strip at its end opposite the fold, whereby the compartment is removably coupled and attached to at least one of the jaws.

According to another feature of the invention, each inner wall and each outer wall of each compartment comprises at least one inner face, intended for being in and/or coming into contact with the liquid or pasty product both in the non-operating position and in the operating position of the device, and at least one outer face opposite the inner face, the inner face being made of an absorbent, non-woven fabric material and the outer face comprising an impermeable layer so that the product does not go through any of the walls forming the container.

According to another feature of the preferred embodiment of the invention, the side edges of each outer wall and the side edges of each inner wall are provided with a pressure-sensitive adhesive for carrying out a removable side sealing in the container such that in the non-operating position, each of the compartments is laterally sealed as the two side edges of its outer wall are removably attached with the respective side edges of its inner wall. Said attachment can gradually come undone as the portion having a laminar structure of each compartment is gradually unfolded in the operating position. Furthermore, as it is gradually unfolded and also when the end operating position is reached, the side edges of the outer wall and the side edges of the inner wall of a container can be attached with the side edges of the outer wall and the side edges of the inner wall of the other container, respectively, to isolate the product applied on the selected locks from the scalp.

According to a second aspect of the invention, a supply of a compartment having a flattened structure arranged for use in a device for selectively bleaching or dyeing a plurality of locks of hair by means of applying at least one liquid or pasty product, in combination with a device according to the preferred embodiment described above, is disclosed.

Said supply compartment is formed by a structure having a laminar portion made of an absorbent, non-woven fabric material folded such that the compartment is formed by an outer wall and an inner wall facing one another and joined at least at their lower ends by means of the fold section. The inner wall and the outer wall are provided with respective adhesive strips at their ends opposite the fold section suitable for the removable coupling thereof, respectively, to a selector comb and to one of the jaws of sealing and holding means provided in the device. The adhesive strips are covered by at least one protective layer that can be removed to uncover the adhesive surface. The side edges of the inner wall and of the outer wall are provided with a pressure-sensitive adhesive. The space demarcated by the outer wall, the inner wall and the fold comprises a liquid or pasty product for dyeing or bleaching the locks, in combination with a device like the device of the preferred embodiment described above.

According to a third aspect of the invention, a method for selectively bleaching or dyeing a plurality of locks of hair by means of applying at least one liquid or pasty product is disclosed. The first step consists of combing a portion of hair containing the locks to be treated with a normal comb, separating the chosen portion from the rest of the hair and holding the combed portion with one hand at the end opposite the scalp.

The method is essentially characterized in that it comprises the following steps:

a) grabbing with the other hand a device described above with each compartment of the container provided with a liquid or pasty product for dyeing or bleaching hair;

b) sinking the set of teeth provided at the free end of the essentially flat portion of the head of the selector comb into the portion of hair that is tensed with the other hand, at a distance comprised between 1 and 5 cm from the scalp;

c) letting go of the portion of hair;

d) with the hand used in step a), holding the free end of the handle-like elongated part of the selector comb and pulling away from the scalp until the set of teeth of the head goes through the space between the two jaws and enters the container, at this point closing the jaws facing one another such that the locks to be treated are grasped between the two jaws;

e) at the same time as the preceding step, bringing the sealing and holding means towards the scalp and closing the jaws so that the sealing and holding means are held firmly against the part adjacent to the scalp forming the beginning of the portion of hair comprising the locks to be treated, f) with the hand used in step d), continue pulling the free end of the handle-like elongated part in the same direction up to the end operating position of the device in which the flattened structure of the container is completely unfolded, a selection of locks of hair being dragged by the teeth shaped like hooks of the selector comb into the inner space of the container and in contact with the liquid or pasty product;

g) allowing the liquid or pasty product in contact with the selection of locks to act for a certain time until causing the dyeing or bleaching thereof; and h) opening the two jaws of the sealing and holding means until the two jaws are separated and releasing the device from the portion of hair.

According to another feature of the method, between step f) and step g) the side edges of the unfolded inner wall and unfolded outer wall of one compartment are pressed against the side edges of the unfolded inner wall and unfolded outer wall of the other compartment for laterally sealing the container in the end operating position.

BRIEF DESCRIPTION OF THE DRAWINGS

Two embodiments of the device for bleaching or dyeing object of the invention are illustrated by way of non-limiting examples in the attached drawings. In said drawings.

DETAILED DESCRIPTION OF THE INVENTION

Figure 1:
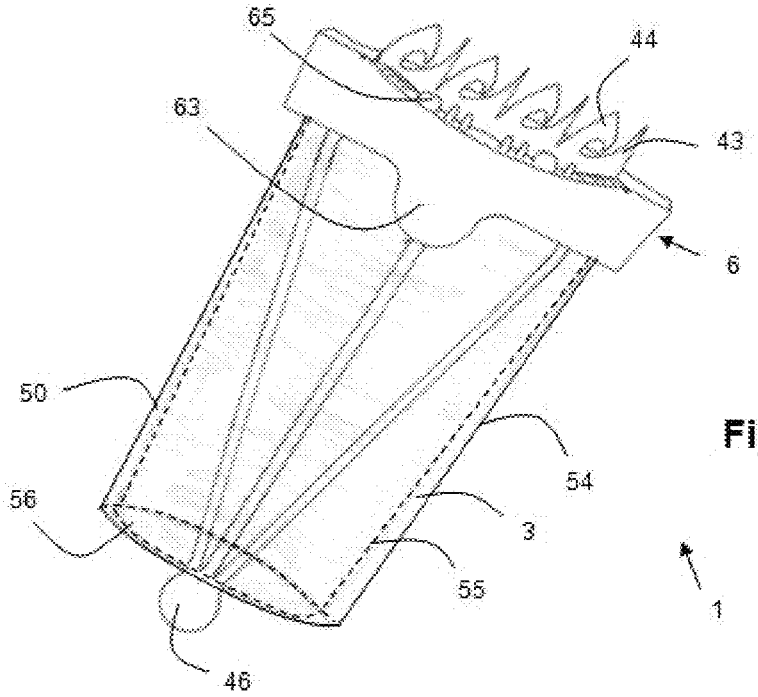
FIG. 1 shows a perspective view of a first embodiment of the device object of the invention in a non-operating position.
Figure 2:
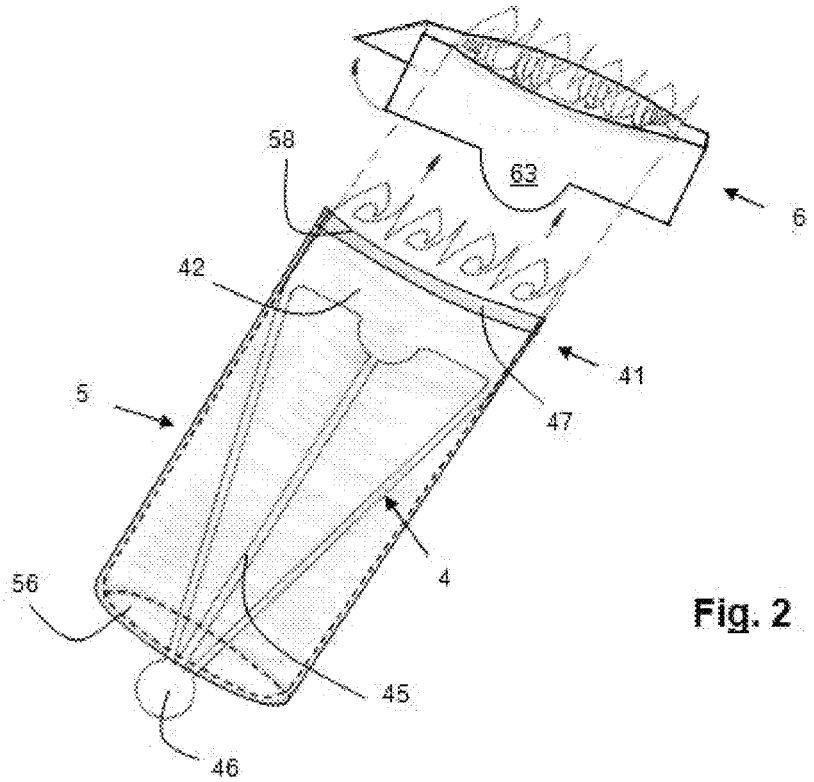
FIG. 2 shows a partial exploded view of the device 1 of FIG. 1 where the position for assembling the sealing and holding means with respect to the assembly formed by the selector comb and the container is shown.
Figure 21:
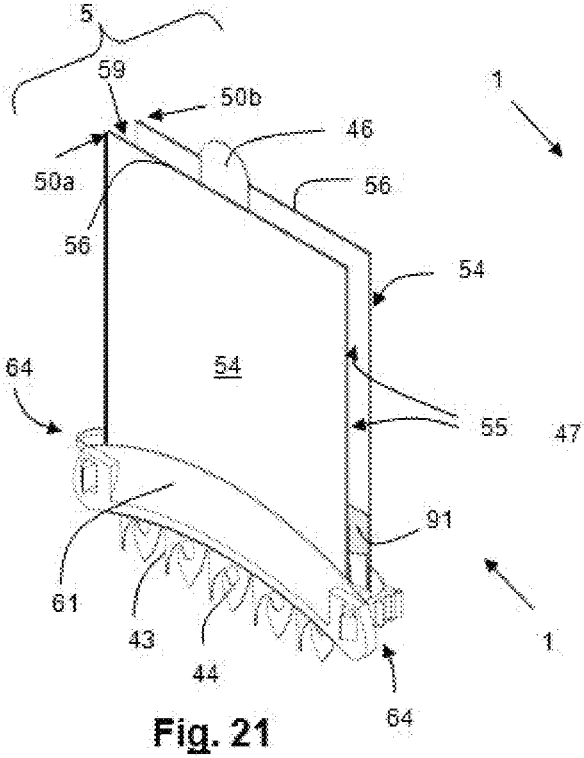
FIGS. 21, 22 and 23 show perspective views of a second and preferred embodiment of the device object of the invention in a non-operating position, in an intermediate operating position and in an end operating position, respectively.
Figure 23:
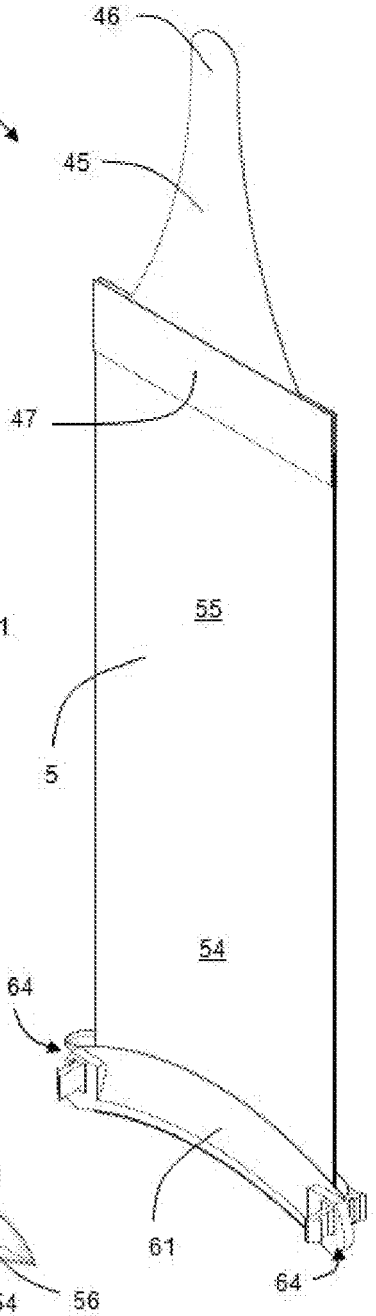
Figure 22:
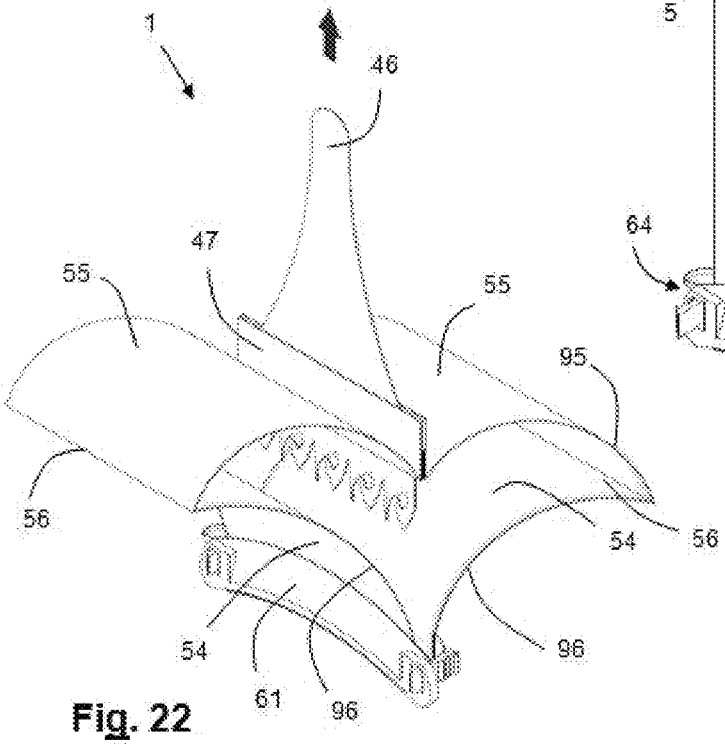

FIGS. 1 and 2 as well as FIGS. 21 to 23 show a device 1 for selectively bleaching or dyeing a plurality of locks 2 of hair by means of applying a liquid or pasty product 3. As can be seen, the device 1 consists of three main components: a selector comb 4 for selecting the locks 2 to be treated, i.e., to be bleached or dyed, a container 5 configured as a flattened structure and provided with at least one compartment 50, 50*a*, 50*b* that can internally house the liquid or pasty product 3, and sealing and holding means 6 provided with two jaws 61 and 62, the shape of which resembles the shape of a hair clip for being able to fix an end of the container 5 to a region of the hair close to the scalp, as will be explained below in further detail. As explained above, the container 5 can be in the form of a flattened tubular sleeve (see FIGS. 1 and 2) or it can be formed by two compartments 50*a* and 50*b* (see FIGS. 21 to 23), each of which is made up of a folded laminar portion (see FIGS. 27 to 31), and by the central space 59 separating said compartments 50*a* and 50*b*.

Figure 3:
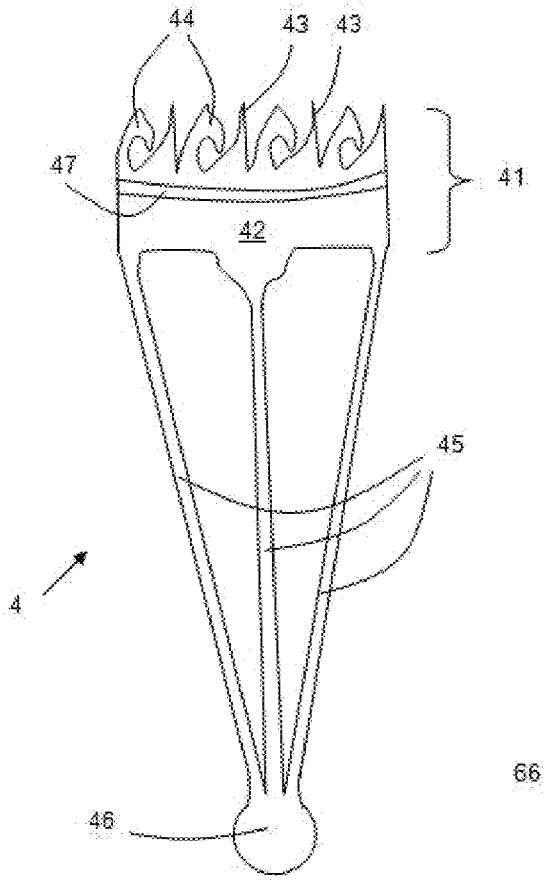
FIG. 3 is an elevational view of the selector comb of FIG. 1.

The selector comb 4, which is depicted separately in FIG. 3, is partially introduced inside the container 5 and is movable inside and along same, as observed in FIGS. 12 to 14 and 21 to 23. The selector comb 4 is coupled to the container 5 such that in an operating position of the device 1, depicted in FIGS. 13 and 20 for example, the movement of the selector comb 4 causes the gradual introduction of an increasingly longer portion of the locks 2 selected by the comb 4 inside the container 5 at the same time as the gradual opening and communication of the inside of each compartment 50, 50*a*, 50*b* with the portion of the locks 2 introduced therein, said portion being exposed to the liquid or pasty product 3.

Figure 6:
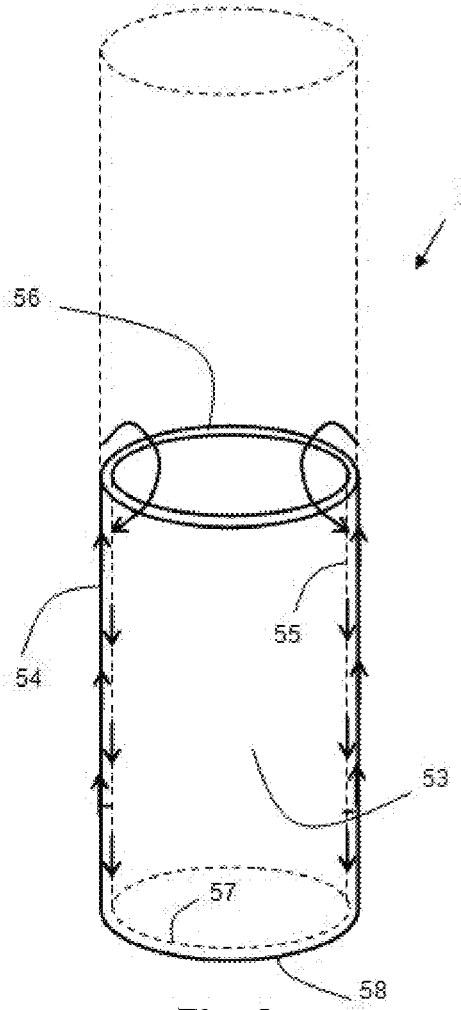
FIG. 6 is a schematic view of the formation of the container in a non-operating position of the device of FIG. 1.
Figure 24:
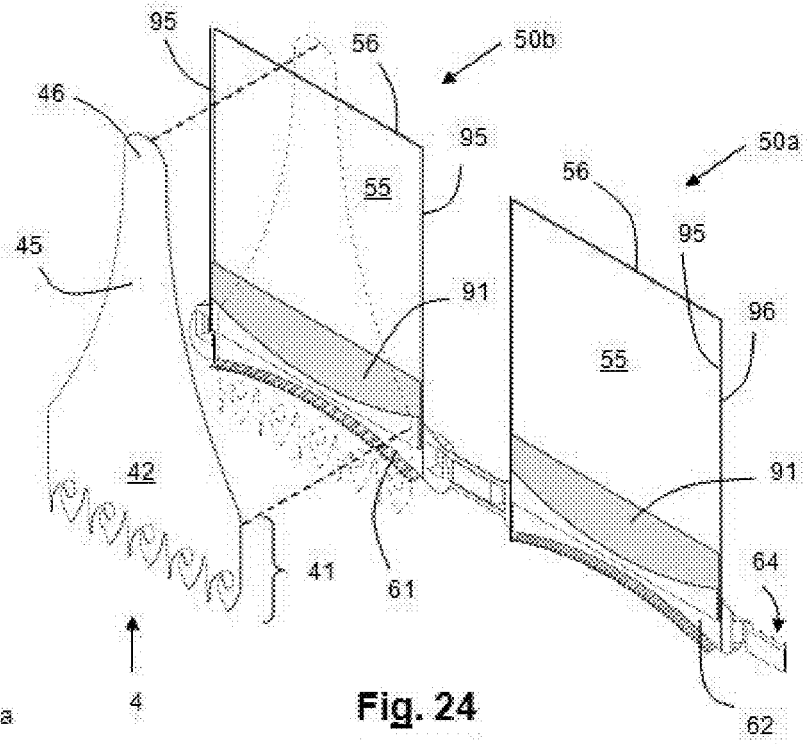
FIG. 24 shows a partial exploded view of the device of FIG. 21.

As can be seen in FIGS. 3 and 24, the selector comb 4 comprises a head 41 formed by an essentially flat portion 42 and provided at its free end with a set of teeth shaped like prongs 43 alternating with other teeth shaped like hooks 44. The head 41 is followed by a handle-like elongated part 45 suitable for being gripped at its free end 46. In the depicted case, the length of the assembly formed by the essentially flat portion 42 and the handle-like elongated part 45 is greater than half the total length of the flattened structure (tubular sleeve in FIG. 3) forming the container 5, considering the length of the structure when it is completely unfolded, as is the case depicted in FIGS. 14, 20 and 23, as the total length. FIG. 6 in particular schematically shows a container 5 in the form of a tubular sleeve, where the mentioned total length would be the length of the solid line sector plus the dotted line sector. This means that the selector comb 4 can be moved down by pulling on the free end 46 projecting from the lower end of the container 5, considering said lower end to be the closest to the free end 46 of the comb 4.

The teeth shaped like hooks 44 resemble a hook-type harpoon the shape of which allows it to correctly penetrate the hair (see FIG. 17) and prevent it from coming out again, several locks 2 selected for treatment being effectively trapped when the selector comb 4 is passed through a portion of hair. The teeth shaped like prongs 43 are in the form of a smooth needle and their function is to penetrate the hair, momentarily separating it, and the hair comes out of them without making any apparent change.

Each lock 2 of hair selected for being subsequently treated enters through the space running between the upper ends of the hooks 44 and the prongs 43, in this order, being housed in this space. The parrot beak shape of the hooks 44 which narrows the mentioned space contributes to this as it allows the lock 2 to enter with a slight touch, but it later cannot come out. As observed, one side of the prongs 43 is straight whereas the other side is curved for guiding the hair to the housing surrounding the parrot beak shape finish between a hook 44 and a prong 43. Furthermore, at the end of the curve on the side of the prong 43 said housing ends in a pronounced and off-centered angle. Precisely this angle correctly centers the hair so that during the normal use of the device 1, it is subsequently dragged by the hooks 44 without the hair finding a way out again. The space comprised between the tip of the parrot beak shape finish and the pronounced angle at the bottom of the housing determines the depth to which the selector comb 4 penetrates the hair, as well as the width of the selected lock 2.

Part of the hair will enter through the space running between the upper ends of the prongs 43 and the hooks 44, in this order, but it will not be trapped, leaving it immune to the subsequent pulling when the person who is applying the highlights pulls on the free end 46 of the handle 45 of the selector comb 4 towards himself/herself.

Figure 12:
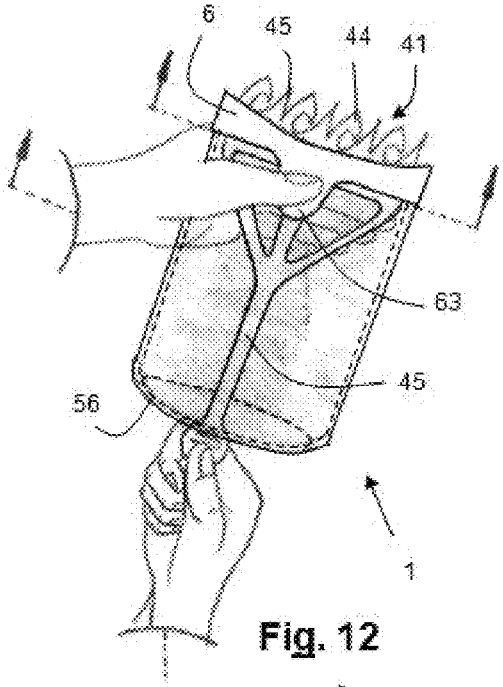
FIGS. 12 to 14 show the device of FIG. 1 in a non-operating position, in an intermediate operating position and in an end operating position, respectively.
Figure 13:
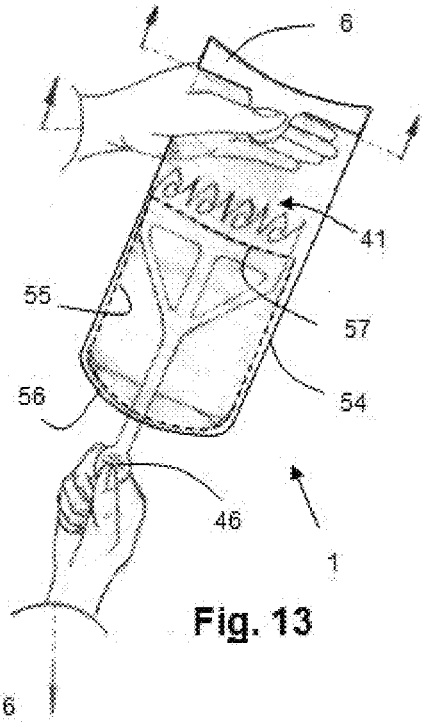
Figure 14:
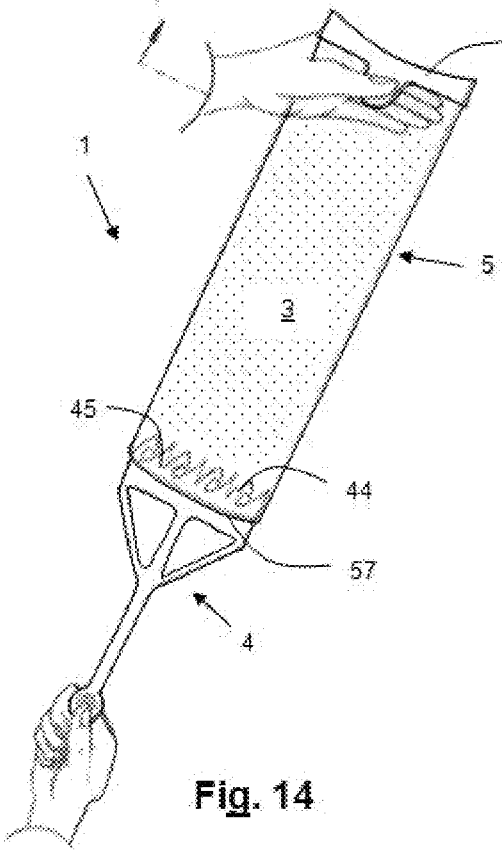

In the selector comb 4 of FIG. 3 the handle-like elongated part 45 is formed by three bands converging at the free end 46, although it can have other configurations, such as the configuration shown in FIGS. 12 to 14, for example, where three branches converge into a single elongated sector before ending at the free end 46, or the configuration of FIG. 24 formed by a single flat transitional sector. What is important is that the handle-like elongated part 45 can be used as a handle during normal operation of the device 1 for moving the head 41 along the inside of the container 5. The free end 46 is depicted with a circular shape and is preferably made of a non-slip material so that it does not slip out of the hand of the person who is applying the highlights when pulling on it towards himself/herself. The head 41 of the comb 4 is preferably made of a less hard and more flexible plastic than the plastic of the handle 45 because the latter must be capable of pulling on the locks 2 without becoming deformed.

An attachment region 47 is distinguished along the width of the flat portion 42 of the head 41, below the set of teeth, depicted in FIG. 3, where the end 57 of the container 5 is sealed. In the comb 4 of FIG. 24, the attachment region 47 would be the part of the comb 4 that would be attached to the adhesive strip 91.

As depicted schematically in FIG. 6, the container 5 corresponding to that of the embodiment of the device 1 of FIG. 1 has a tubular sleeve structure which in a non-operating position of the device 1 (FIGS. 1, 11*a*, 12 and 18), is arranged folded and introduced inside the cavity of the sleeve itself or central space 59, specifically a portion equivalent to half the total length of the case is introduced. The container 5 can be manufactured from a microporous plastic or from a material with the same flexibility or properties, although it is preferably made of an absorbent, non-woven fabric material, of the type known as spunlace-type paper laminated on one side. The absorbent, non-woven fabric material will allow the inner faces of the inner wall 55 and outer wall 54 of the container 5, i.e., the faces in direct contact with the product 3, to become impregnated with the product for better application on the locks 2 and to in a way stop it from accidentally spreading beyond the limits of the container. The purpose of the lamination is to make the outer face of the container 5 impermeable to prevent the liquid or pasty product 3 from exiting the container 5. In fact, the amount of product 3 comprised in the compartments 50, 50*a* or 50*b* is similar to that of a brushstroke, a thin layer with which the inner faces of the container 5 are impregnated.

Figure 7:
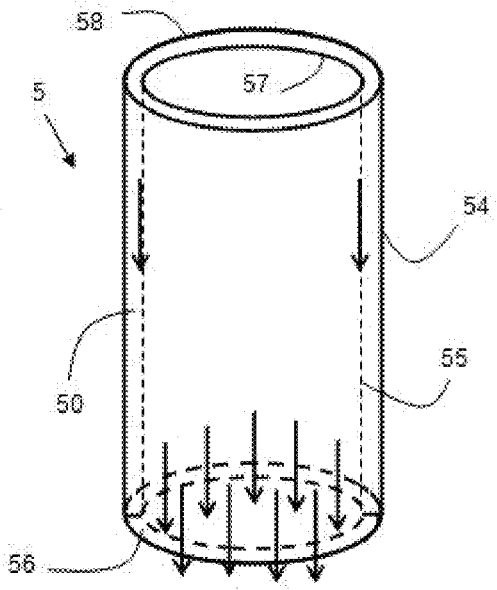
FIG. 7 is a schematic view of the container of the device of FIG. 1 in an instant prior to the device adopting an operating position.

The arrows of FIG. 6 show the direction of the fold of the sleeve which was initially unfolded and which forms the container 5 in the non-operating position according to the first embodiment of the device 1 corresponding to FIG. 1 when it is folded in half and the upper half depicted by means of dotted lines is introduced inside the cavity of the case. Therefore in said non-operating position, the container 5 depicted in FIG. 7 is formed by a double-walled hollow tubular body 53, the cavity or central space 59, an outer wall 54 and an inner wall 55, provided with at least one compartment 50 formed by the space demarcated between the outer wall 54, the inner wall 55 and the joint section of these walls at one of the ends of the tubular body 53 coinciding with the section of the fold 56 of the tubular sleeve. As particularly observed in FIGS. 1, 2, 9 and 12, the cavity or central space 59 of the tubular body 53 houses part of the selector comb 4.

Figure 8:
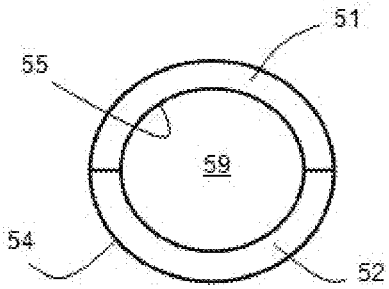
FIG. 8 is a plan view of the container of FIG. 7 in which two semi-compartments are seen.
Figure 9:
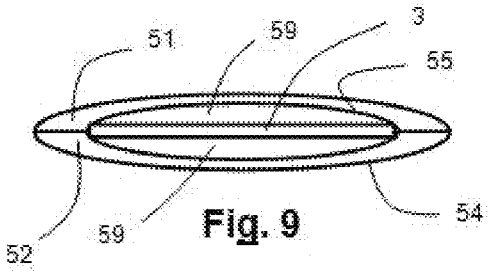
FIG. 9 is a schematic plan view of the assembly formed by the container and the selector comb of FIG. 2.
Figure 11A:
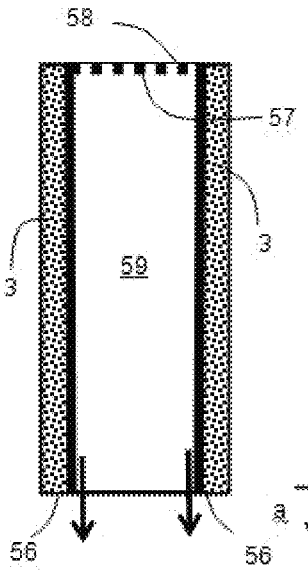
FIGS. 11*a* to 11*f* schematically show the progressive unfolding experienced by the tubular sleeve of the container and the movement of the liquid or pasty product from a non-operating position to an operating position.
Figure 11B:
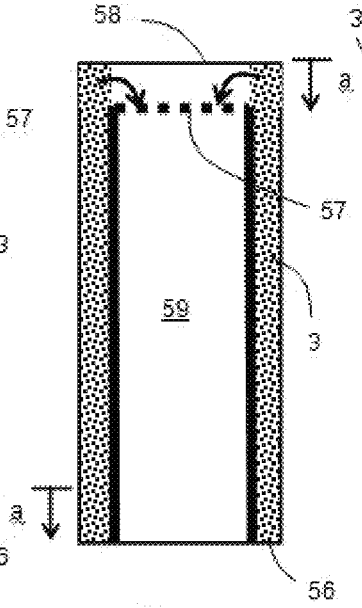
Figure 11C:
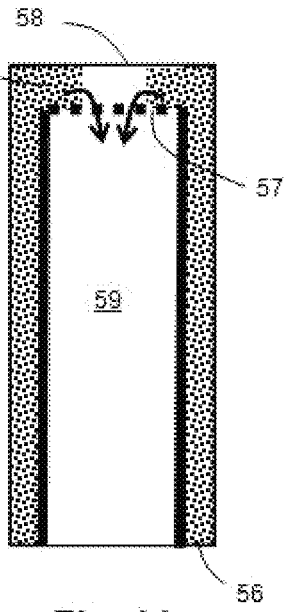
Figure 11D:
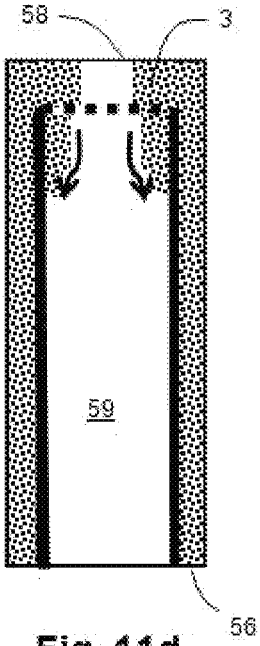
Figure 11E:
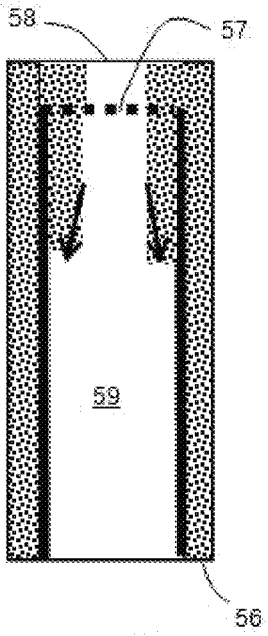
Figure 11F:
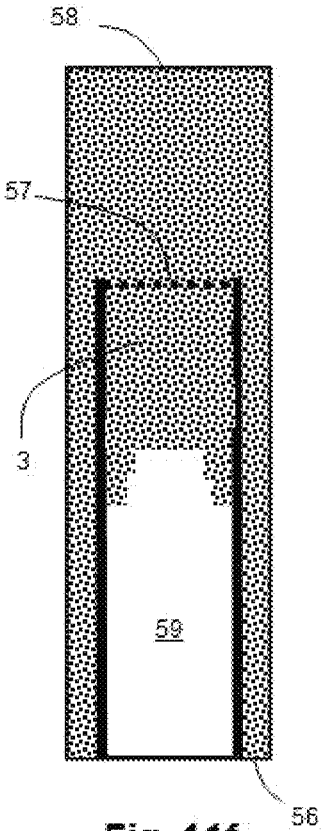

The liquid or pasty product 3 for dyeing or bleaching hair is provided inside the compartment 50 demarcated by the space formed between the outer wall 54, the inner wall 55 and the attachment sector for attaching these walls along the fold section 56 of the tubular case, as schematically shown in the longitudinal section of the container 5 in the non-operating position of FIG. 11*a*, in which the product 3 is confined by the fold 56, the outer wall 54 and the inner wall 55. As mentioned, the required amount of product 3 is very small, like a brushstroke, although FIG. 11 shows a larger amount for explanatory purposes in order to see how the product 3 is spread or how it impregnates the container 5. Optionally, the compartment 50 can be divided into at least two semi-compartments 51 and 52, shown in FIGS. 8 and 9, extending in the axial direction of the tubular body 53 and containing different liquid or pasty products 3 which react when contacted with one another, causing the dyeing or bleaching of the hair. Therefore, the manufacturer of the device 1 could fill these semi-compartments 51 and 52 with the colorants and oxidizers that will later lead to dyeing the hair, and they will be mixed when the device 1 is in an operating position.

In the non-operating position of the device 1, both in the embodiment of FIG. 1 and in the embodiment of FIG. 21, the essentially flat portion 42 of the selector comb 4 is coupled or sealed by the attachment region 47 to the end 57 of the inner wall 55 opposite the fold 56, the comb 4 being arranged inside the cavity of the tubular body 53, with the exception of the free end of the head 41 where the set of teeth is provided and of the free end 46 of the handle-like elongated part 45, which project respectively from the ends of the container 5 in the non-operating position of the device 1. In contrast, in the operating position of the device 1 (FIGS. 13 and 22) and in the end operating position (FIGS. 14 and 23), the free end of the head 41 which is provided with the set of teeth shaped like hooks 44 and prongs 43 is located inside the cavity or central space 59 of the container 5.

Figure 10:
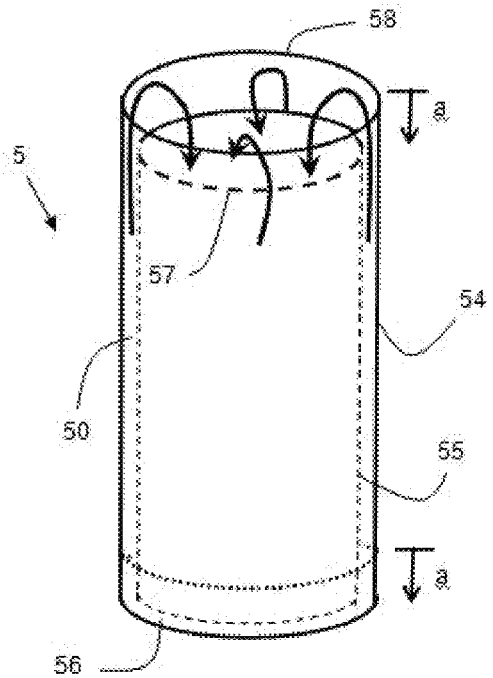
FIG. 10 is a schematic view of the container of FIG. 7 in an operating position of the device.

In fact, in an operating position of the embodiment of the device 1 of FIG. 1, the inner wall 55 of the hollow tubular body 53 is dragged by the selector comb 4 towards the fold 56 of the tubular sleeve, following the direction of the arrows of FIG. 7, causing the movement and shortening (see distance a in FIG. 10) of said inner wall 55 with respect to the outer wall 54 which in turn remains fixed at its end 58 opposite the fold 56 to the sealing and holding means 6 by the inner parts of the jaws 61 and 62. Since the inner wall 55 is dragged by the selector comb 4, as the person who is applying the highlights pulls on the handle 45 of the comb 4, the unfolding of the tubular sleeve takes place up to the end operating position depicted in FIG. 14 in which the tubular sleeve is completely unfolded and provided with a single wall.

The gradual unfolding and its effect is schematically depicted in the initial stages in the sequence of FIGS. 11*a* to 11*f*, where only the container 5 and the position occupied by the product 3 initially contained in the non-operating position (FIG. 11*a*) between the outer wall 54, the inner wall 55 and the fold 56 joining said walls to one another on the lower portion thereof are depicted. As the comb 4 drags the inner wall 55 downwards (towards the fold 56), it makes the end 57 thereof move downwards and therefore no longer contain the product 3, as if a gate were opened, which product 3 will gradually advance towards the cavity of the tubular body 53 and fill it little by little as the comb 4 is moved downwards. The selected locks 2 trapped between the pairs of hooks 44 and prongs 43 are also dragged downwards (downwards is understood as towards the end of the locks 2) with the movement of the comb 4, introducing an increasingly longer portion of locks 2 inside the cavity of the tubular sleeve of the container 5. Therefore in an operating position, the selected locks 2 contact the product 3, which after a certain time causes the dyeing or bleaching of the locks inside the cavity.

In fact, it should be stressed that the product 3 actually forms a thin layer or brushstroke of pasty product 3 applied for impregnating the inner faces of the container 5 in the compartment 50 or in the semi-compartments 51 and 52 (shown in FIG. 9), as the case may be.

Figure 4:
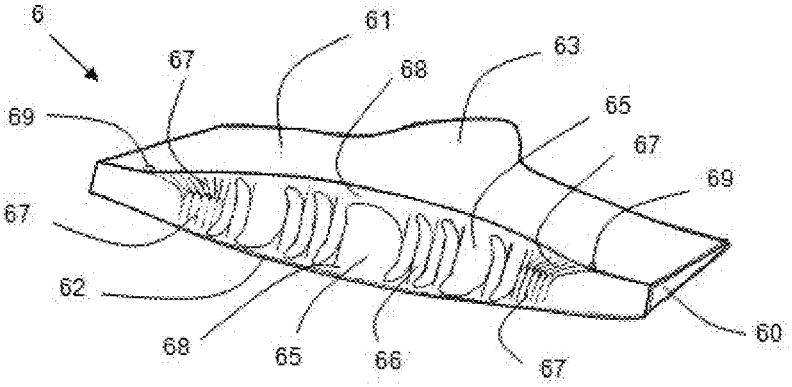
FIG. 4 is a perspective view of the sealing and holding means of FIG. 1.
Figure 18:
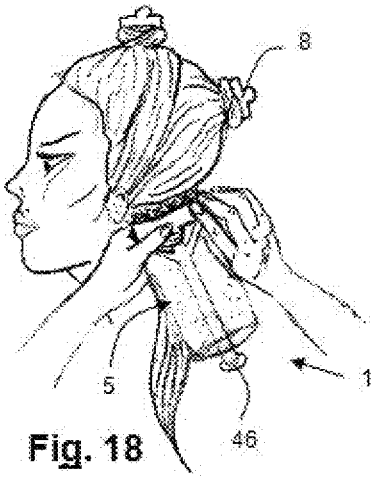
Figure 20:
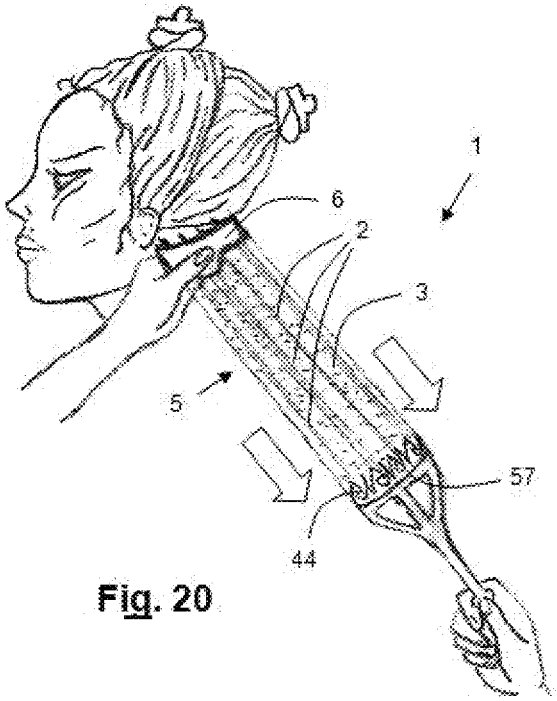
Figure 19:
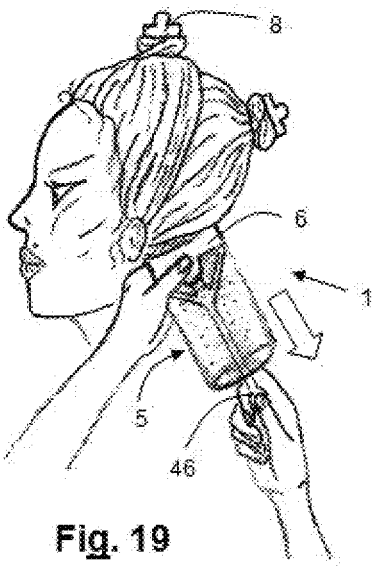

The third basic component of the device 1 is the sealing and holding means 6 depicted separately in FIGS. 4 and 5, provided with two jaws 61 and 62 for the removable fixing of the end 58 of the outer wall 54 of the container 5 opposite the fold 56 to a region of the hair close to the scalp (see FIGS. 18 to 20).

The sealing and holding means 6 of the first embodiment of the device 1 according to FIG. 1 also comprise two support surfaces like pressure-activated closure means 63 for attaching the two jaws 61 and 62 to one another. Precisely the end 58 of the outer wall 54 of the container 5, the end opposite the fold 56, is coupled by the inner face of these support surfaces.

The distal ends of the jaws 61 and 62 face one another and are configured, as previously mentioned, for firmly grasping a region of the hair close to the scalp or any other element interposed between the two jaws 61 and 62 in response to the lack of external forces.

In the absence of external pressure forces on the support surfaces and having exerted sufficient pressure on them, when the jaws 61 and 62 are held against the hair they provide a leak-tight closure of the container 5, preventing the product 3 from coming out. This is because the support surfaces are firmly coupled to respective end regions of the container 5, adjacent to the end 58 of the outer wall 54.

In the non-operating position of the device 1, the free end of the head 41 of the selector comb 4 provided with the set of teeth is located on the outside of the two jaws 61 and 62, as depicted in FIGS. 1 and 12.

The leak-tight closure provided by the two jaws 61 and 62 of the sealing and holding means 6 of FIG. 4 both in the non-operating position of the device 1 and in an operating position in which the sealing and holding means 6 are already fixed close to the scalp in the absence of external pressure forces on the support surfaces, is possible as a result of the two jaws 61 and 62 being provided with a set of teeth shaped like cantilever tabs 65 and 66. As observed in the detail of FIG. 5*a* and of FIG. 5*b*, the cantilever end portions of the tabs 65 and 66 are correlatively curved forwards and backwards in one and the same jaw and in the opposite manner with respect to the respective facing teeth belonging to both jaws. The teeth therefore fit together by the superimposition of their cantilever end portions, also enabling an effective grasp on the hair and the passage of the selected locks 2 without affecting the tightness of the container 5. To release the hair from the grasp, once the highlights are applied it is sufficient to press the side of the sealing and holding means 6 or open the jaws 61, 62 by deactivating the closure means 63, particularly by pressing the side faces 60 shown in FIG. 4 using one's fingers.

With respect to the teeth shaped like tabs, it is observed that tabs 65 are wider than other tabs 66, in addition to certain clusters 67 at the ends, are distinguished.

The teeth shaped like tabs 65 are wider and serve to guide the jaw 61 on the jaw 62 and keep them perfectly aligned, further channeling the entrance of hair towards the teeth shaped like tabs 66.

The teeth shaped like tabs 66 are where the selected locks 2 enter, and they are pinched between their merger points. The shape thereof allows the device 1 to be anchored and held firmly against the hair throughout the entire operation.

The clusters 67 are formed by much narrower teeth. The teeth of the upper jaw 61 are inclined toward the center of the jaw. They are placed almost horizontally so they slip towards the inside of the facing cluster of the other jaw 62, thus assuring a correct closure. It should be mentioned that the other cluster 67 of the jaw 62 is arranged vertically to assure that this region is more solid and to assure that they are located in front of the teeth of the cluster 67 of the other jaw 61.

The curvature of the end portions of the teeth is the result of having applied certain torsion on the teeth to form the jaws 61 and 62. The sealing and holding means 6 have certain, albeit reduced, mobility and flexibility that tend to close as a consequence of the stress caused by the torsion and folding action applied for manufacturing said means. This configuration allows the liquid or pasty product 3 dyeing or bleaching the hair inside the container 5 to not come out of the container 5 at any time during the use of the device 1 so that it does not affect adjacent portions of hair that are not to be treated.

Figure 5A:
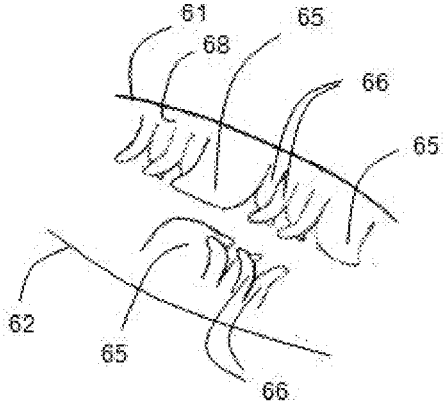
FIGS. 5*a* and 5*b* are detail views of some of the teeth provided in the jaws of the sealing and holding means of FIG. 4.
Figure 5B:
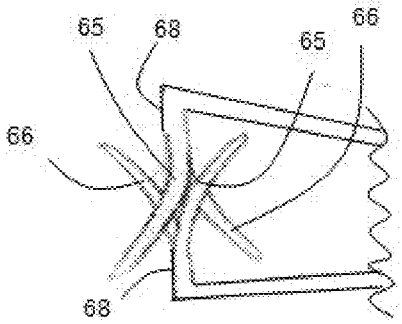
Figure 5C:
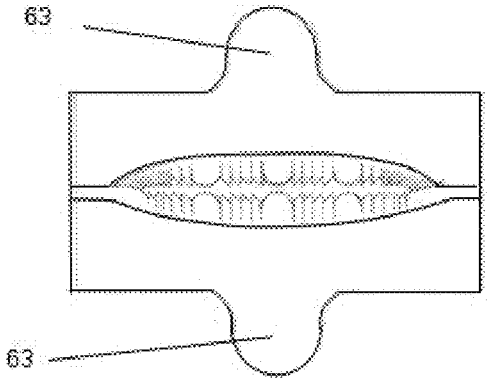
FIG. 5*c* is a plan view of a flat laminar portion from which the sealing and holding means of FIG. 4 can be obtained.

FIGS. 4, 5*a* and 5*b* show that the teeth shaped like tabs 65 and 66 as well as the clusters 67 do not originate directly from the edge of the front faces of the jaws 61 and 62 but rather there is a small gap 68 that provides great rigidity and stability to the sealing and holding means 6. The gap 68 thereby allows the teeth to remain firm because without said space, the teeth would be weak and would not correctly establish the leak-tight closure of the opening of the container 5.

Another component of the sealing and holding means 6 to be highlighted particularly depicted in FIG. 4 are the small prolongations 69 of the die cut located at the ends of the alignment of the teeth of the jaw 61, as can be seen in FIG. 4. Said prolongations 69 have the shape of very small circumferences and their function is to alleviate stresses of the jaws 61 and 62 when part of the selector comb 4, specifically its head 41, is introduced between same, i.e., prevent excessive pressure between the jaws 61 and 62 against the comb 4. The alleviation of stresses can be necessary when the sealing and holding means 6 were obtained from a flat, cut and folded laminar portion of plastic material. The laminar portion shown in FIG. 5*c* has little thickness, which allows folding the sheet along fold lines for forming the sealing and holding means 6 in a simple and rather inexpensive manner. As can be seen, the laminar portion yet to be folded has an essentially rectangular shape, one of the two dimensions of the rectangle being similar to the width of the flattened container 5.

The following description in reference to FIGS. 12 to 14 is provided considering that the user of the device 1 is a right-handed person. Left-handed people will place their hands in the opposite manner.

According to FIG. 12, the device 1 must be placed on the palm of the left hand facing upwards. The support surfaces are held using the thumb and index finger. Next, the right hand is used to hold the free end 46 of the selector comb 4. In FIG. 12, once the sealing and holding means 6 are fixed close to the scalp and pressure is no longer applied on the support surfaces, the left hand firmly holds the sealing and holding means 6 but without applying pressure. Then, the right hand is used to gradually pull the free end 46 or the handle 45 downwards, moving it away from the head. The action will be performed slowly but progressively until the teeth of the comb 4 reach the end of the inside of the container 5 (FIG. 14), like a stop.

The way to use the device 1 for bleaching or dyeing hair is described below by means of FIGS. 15 to 20.

Figure 15:
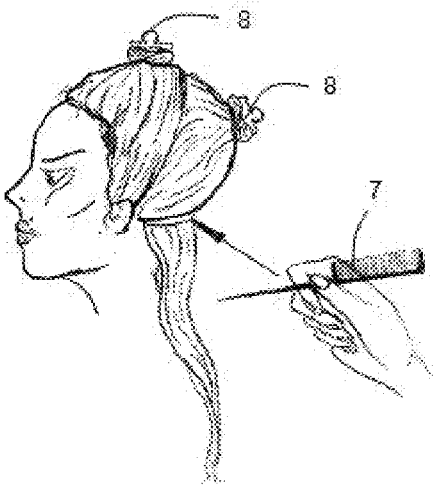
FIGS. 15 to 20 show steps of the method for selectively bleaching or dyeing a plurality of locks using the device of FIG. 1.
Figure 16:
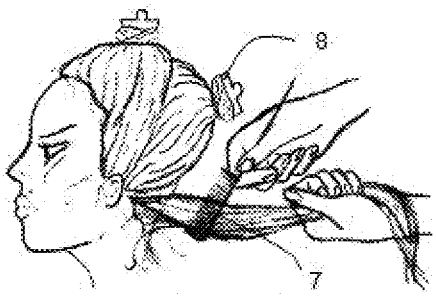
Figure 17:
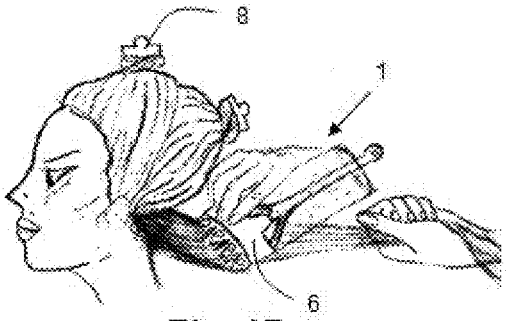

FIG. 15 shows how the region to be dyed is selected. The person who is operating the device 1 draws a straight line with a normal comb 7 and holds the rest of the non-selected hair with a clip 8. Partitions can previously be selected. Next, the left hand holds the portion of hair with the locks 2 to be dyed after having passed the normal comb 7 through the hair, so the portion of locks is organized (see FIG. 16). Then the device 1 is grabbed with the right hand in the upper region of the sealing and holding means 6 and is introduced in the portion of locks 2 at a distance of 3 or 4 cm from the scalp, as indicated in FIG. 17. In FIG. 18, the left hand lets go of the portion of locks 2 and then holds device 1 by the support surfaces of the closure means 63.

From the preceding position, the right hand then holds the device 1 by the free end 46 of the selector comb 4 (see FIG. 19). Finally, as shown in FIG. 20, the sealing and holding means 6, which are still held with the left hand, are gently and firmly pushed towards the scalp. At the same time the free end 46 is slowly but progressively pulled with the right hand in the opposite direction along the container 5, which in turn acts as a stop. In FIG. 20, the product 3 is now located inside the cavity of the container 5 as are the locks 2 dragged by the teeth of the selector comb 4 and introduced in said cavity through the teeth of the sealing and holding means 6.

The device 1 therefore provides a simple and clean manner of applying highlights in the hair. Furthermore, the container 5 can be manufactured from a transparent or translucent material, so the person who is applying the highlights can see if the locks 2 have acquired the desired tone before removing the device 1 and washing the hair.

FIGS. 21 to 26 show a preferred embodiment of the device 1 as well as the assembly of its components. The device 1 configured as shown in said drawings allows quickly and simply refilling the device 1 with compartments 50*a* and 50*b* already provided with the product 3 for bleaching or dyeing hair, so that after one use the same device 1 can be used immediately for treating other locks 2. As will be explained below, each of the compartments 50*a* and 50*b* is made from a laminar portion folded as shown in the steps indicated in FIGS. 27 to 31.

The device 1 of FIG. 21 is depicted in the non-operating position, in which as observed, the container 5 comprises two compartments 50*a*, 50*b* having a flattened structure, coupled to the selector comb 4 and arranged symmetrically with respect to said comb. The product 3 for dyeing or bleaching hair is located inside the compartments 50*a* and 50*b*. The central space 59 existing between the two compartments 50*a* and 50*b* in which the comb 4 is partially introduced is also part of the container 5. Each compartment 50*a*, 50*b* is formed by a structure having a folded laminar portion (see FIGS. 27 and 28) such that each compartment 50*a*, 50*b* is formed by an outer wall 54 and an inner wall 55 opposite one another and joined by one of the sides thereof by means of the fold 56. The inner walls 55 form the central space 59 of the container 5 when it is in a non-operating position, and the end 57 of each inner wall 55, opposite the fold 56, is coupled to the selector comb 4 through an adhesive strip 91 provided at its end 57.

In an operating position of the device 1 shown in FIG. 22, when pulling the comb 4, the unfolding of the laminar structure of each compartment 50*a*, 50*b* takes place up to an end operating position shown in FIG. 23, in which each laminar structure is completely unfolded and the container 5 is formed by two walls, each of a length equivalent to the sum of the outer wall 54 plus the inner wall 55 of the non-operating position, and by the central space 59 comprised between said two walls.

For operation, each compartment 50*a*, 50*b* contains in the space formed between the outer wall 54 and the inner wall 55 the same liquid or pasty product 3 or a different one, for example one being a colorant and the other being an oxidizer, which reacts when contacted with the product 3 of the other compartment, causing the dyeing or bleaching of the locks 2 selected by the comb 4 inside the container 5. The nature of the product 3 will depend on of the type of coloring or bleaching to be carried out.

Each outer wall 54 and each inner wall 55 comprises an inner face intended for being in and/or coming into contact with the liquid or pasty product 3, being impregnated with it, both in the non-operating position and in the operating position of the device 1, and an outer face opposite the inner face. As mentioned above, said inner face is preferably made of an absorbent, non-woven fabric material, whereas the outer face is covered with an impermeable layer so that the product 3 does not go through any of the walls forming the container 5.

The outer wall 54 of each compartment 50*a*, 50*b* is provided with an adhesive strip 92 (see FIG. 25) at its end 57 opposite the fold section 56, whereby the compartment 50*a*, 50*b* is removably coupled and attached to a respective jaw 61, 62.

The side edges 96 of each outer wall 54 and the side edges 95 of each inner wall 55 are optionally and preferably provided with a pressure-sensitive adhesive for carrying out a removable side sealing in the container 5. In the non-operating position, each of the compartments 50*a*, 50*b* is therefore laterally sealed as the two side edges 96 of its outer wall 54 are removably attached with the respective side edges 95 of its inner wall 55. This attachment gradually comes undone as the portion having a laminar structure of each compartment 50*a*, 50*b* is gradually unfolded in the operating position. As it is gradually unfolded and especially once the end operating position is reached, the user can apply pressure to attach the side edges 96 of the outer wall 54 and the side edges 95 of the inner wall 55 of a container 50*a* with the side edges 96 of the outer wall 54 and the side edges 95 of the inner wall 55 of the other container 50*b*, respectively, in a sealed manner.

Another option is that none of the side edges 95 or 96 be sealed in any way because the roughness of the material used in making the compartments 50*a* and 50*b* can stop the advance of the product 3, preventing it from spreading out laterally and coming out of the space comprised between the outer wall 54 and the inner wall 55 of the compartment 50*a*, 50*b* at hand.

Figure 27:
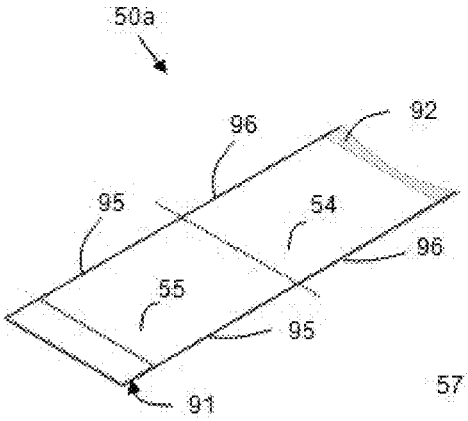
FIGS. 27 to 31 show the phases of forming one of the compartments of the container of the device of FIG. 21.

FIGS. 27 to 31 show the formation of the compartment 50*a* in detail (also valid for the compartment 50*b*). FIG. 27 shows an elongated laminar portion provided at one end with an adhesive strip 92, the adhesive surface of which is shown face up, and having another adhesive strip 91 at the opposite end, the adhesive surface thereof being oriented downwards in the position shown. A rectangular portion with adhesive on one face, the lower face according to the position of FIG. 27, which contributes to forming the mentioned adhesive strip 91, is observed at the free end of the part which will later form the inner wall 55.

Figure 28:
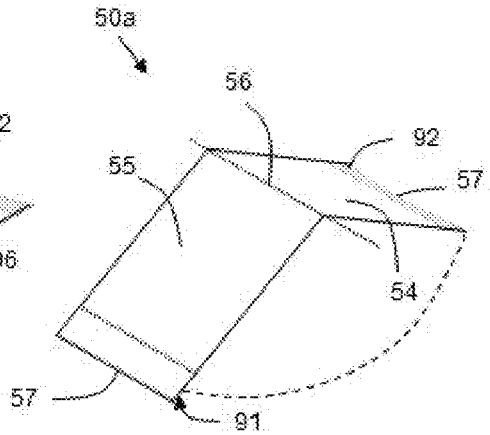
Figure 29:
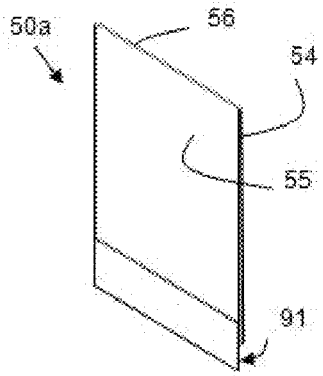
Figure 30:
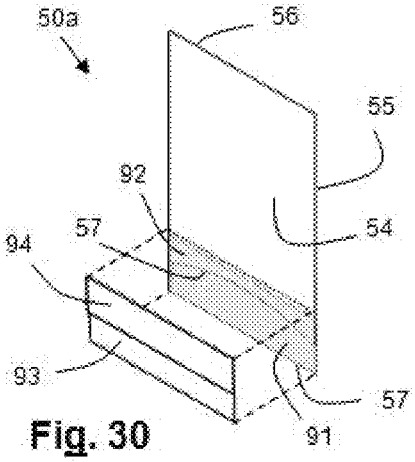
Figure 31:
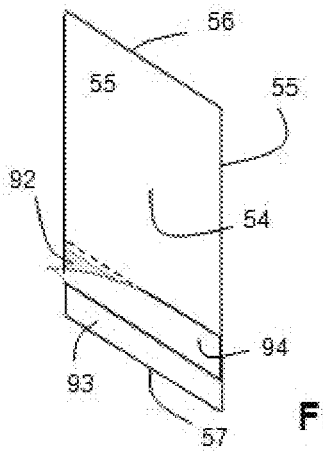

In FIG. 28, the elongated laminar portion is folded along the fold 56 line, then being in the position shown in FIG. 29. The resulting container 50*a* has two walls referred to as outer wall 54 and inner wall 55, according to the position they will occupy in the device 1, said walls being attached by the end of the fold 56. As can be seen in FIG. 30, the adhesive strips 91 and 92, which are oriented in one and the same direction according to the depicted example, are located at the ends 57 opposite the fold 56. The adhesive strips 91 and 92 are covered by a protective layer 93, 94 that can be removed by the user to prevent the compartment 50*a* from adhering to the nearby surfaces before being assembled in the device 1. Specifically in FIG. 30, the protective layer 93, 94 is formed by a single piece of paper in which the upper region would be intended for covering primarily the adhesive strip 92 and the lower region would be intended for covering primarily the adhesive strip 91, although both regions can contribute to covering parts of both adhesive strips 91 and 92 to a greater or lesser extent.

Before applying the protective layer or layers 93, 94, compartment 50*a* preferably already comprises the product 3 therein, with its inner faces being impregnated. This is because the elongated laminar portion of the non-woven fabric material from which the compartments 50*a*, 50*b* are manufactured preferably comes from a continuous roll coupled to a machine which in successive phases gradually impregnates one of its faces with the corresponding product 3, cuts it according to the measurements of the elongated portion, makes the adhesive strips 91 and 92 and folds each portion. The side edges 95 and 96 provided with a pressure-sensitive adhesive will then be attached to one another, being temporarily sealed.

After having laterally sealed the compartment 50*a* and having applied the protective layer or layers 93, 94 (FIGS. 30 and 31), the compartment 50*a* is ready to be placed for use in the device 1. In fact, the compartment 50*a* shown in FIG. 31, in which a corner of the protective layer 93, 94 is depicted as being partially detached to show that the adhesive strip 92 is located under it, forms a supply compartment 50*a*, i.e., a quick-to-assemble compartment 50*a* ready to be used in the device 1 like a consumable filler.

Figure 25:
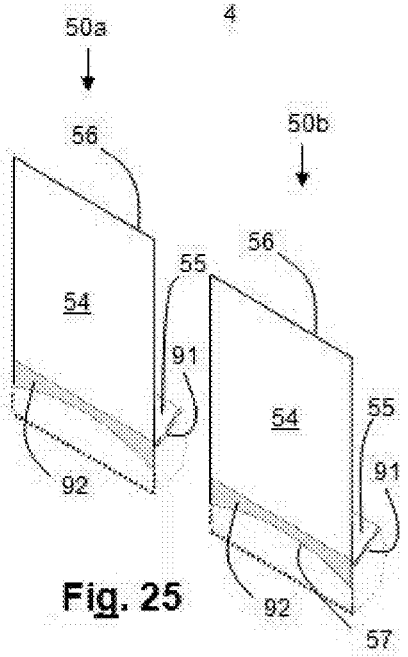
FIGS. 25 and 26 show two prior phases in assembling the device depicted in FIG. 24.
Figure 26:
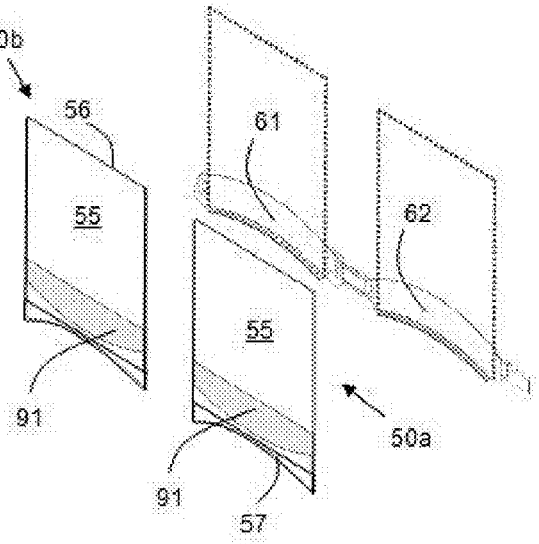

The assembly for the use of said supply is shown in FIGS. 25, 26 and 24, in this order. FIG. 25 shows two supply compartments 50*a* and 50*b* like the one in FIG. 31. In FIG. 25, the protective layer or layers 93, 94 are removed and the free end of the inner wall 55 is folded backwards such that the adhesive surface of the adhesive strip 91 is oriented in a direction opposite the adhesive surface 92. In FIG. 26, the two supplies of compartments 50*a* and 50*b* are placed with the outer walls 54 facing the inner faces of the jaws 61 and 62, and the ends 57 of said outer walls 54 will be attached to said surfaces by the adhesive strips 92. As seen, the lower curved profile of the inner faces of the jaws 61 and 62 is similar to the curved profile of the end 57, edge of the adhesive strip 92. The result of this coupling between the sealing and holding means 6 by adhesive attachment is shown in FIG. 24, in the part indicated by the dotted line, where the adhesive strip 92 of the outer wall 54 of the compartment 50*b* is attached to the inner surface of the jaw 61. Continuing with FIG. 24, to finish the assembly the comb 4 is simply attached along its two faces to the respective adhesive strips 91 and the two jaws 61 and 62 are closed with the closure means 64 provided at their ends. As can be seen, the closure means 64 are adjustable in the sense that they allow maintaining a larger or smaller gap between the two inner walls 55 depending on the thickness of the selected locks 2 and gradually pressing the comb 4 against the adhesive strips 61 and also the adhesive strips 62 with the inner faces of the jaws 61 and 62. By applying pressure on and closing the sealing and holding means 6 with the closure means 64, the adhesive strip 92 of the compartment 50*b* will be attached to the inner face of the jaw 62. In fact, the closure means 64 can attach or couple the two ends of the jaws 61 and 62 when the set of teeth of the comb 4 has passed along the scalp (the situation equivalent to the situation in FIG. 17) and the sealing and holding means 6 are going to be fixed to the scalp (FIG. 18). The teeth of the two jaws 61 and 62 are elongated and perpendicular to the inner faces thereof. When the closure means 64 are active, said teeth are intertwined with one another, leaving just enough space for the passage of the locks 2 between each pair of intertwined teeth.

Once the device 1 has passed on to the end operating position, the user will press the side edges 96 and 95 of the unfolded compartment 50*a* against the side edges 96 and 95 of the unfolded compartment 50*b* to laterally seal the container 5. When the time necessary for the selected locks 2 to be dyed or bleached by contact with the product 3 has elapsed, it will be enough to decouple the supplies of compartments 50*a*, 50*b*, by removing the adhesive strips 91 and 92 from the comb 4 and from the jaws 61 and 62 and replacing them with another pair of supplies of 50*a* and 50*b*. The material used to manufacture the supply of compartments 50*a* and 50*b* has been envisaged so that said compartments can be disposable.

The invention claimed is:

1. A device for selectively bleaching or dyeing a plurality of locks of hair by applying at least one liquid or pasty product, comprising a selector comb for selecting the locks to be bleached or dyed from a portion of hair, and a container provided with at least one compartment that can internally house the liquid or pasty product;

wherein the selector comb is partially located inside the container and is movable inside and along the container, the selector comb being coupled to the container such that movement of the selector comb when operating the device causes gradual introduction of an increasingly longer portion of the locks selected by the selector comb inside the container at a same time as a gradual opening and communication of an inside of the at least one compartment with the portion of the locks introduced inside the container, said portion of the locks being exposed to the liquid or pasty product;

wherein the container has a flattened tubular sleeve structure having a first end and an opposite second end at or near where the selector comb is coupled to the container, such that prior to operating the device, the tubular structure is folded within itself with the second end located within a portion of the tubular structure, thereby defining a body comprising a double wall formed by an outer wall and an inner wall and a central space that is demarcated by the inner wall and in which the selector comb is partially located, and wherein the body has the at least one compartment formed by a volume demarcated between the outer wall, the inner wall and a joint section of the outer wall and the inner wall at a fold of the flattened structure; and wherein the inner wall is configured to be dragged by the selector comb towards the fold of the flattened structure during operation of the device, causing movement and shortening of the inner wall relative to the outer wall, and thereby lengthening of the outer wall by a corresponding amount, and unfolding of the flattened structure up to an end operating position in which the flattened structure is unfolded and with the central space limited by a single surrounding wall defined by the outer wall.

2. The device according to claim 1, wherein the at least one compartment comprises at least one liquid or pasty product for dyeing or bleaching hair in the space formed between the outer wall, the inner wall and the joint section of these walls along the fold.

3. A device for selectively bleaching or dyeing a plurality of locks of hair by applying at least one liquid or pasty product, comprising a selector comb for selecting the locks to be bleached or dyed from a portion of hair, and a container comprising two compartments that can internally house the at least one liquid or pasty product;

wherein the selector comb is partially located inside the container and is movable inside and along the container, the selector comb is coupled to the container such that movement of the selector comb when operating the device causes gradual introduction of an increasingly longer portion of the locks selected by the selector comb inside the container at a same time as a gradual opening and communication of insides of the two compartments with the portion of the locks introduced inside the container, said portion of the locks thereby being exposed to the liquid or pasty product; and wherein in a non-operating position of the device the two compartments have a flattened structure, coupled to the selector comb and arranged symmetrically with respect thereto, and a central space between the two compartments in which the comb is partially introduced, wherein each compartment is formed by a folded portion having a laminar structure such that each compartment is formed by an outer wall and an inner wall facing one another and joined at one end by the fold, the two inner walls being what form the central space, and the other end of each inner wall, opposite the fold, being coupled to the selector comb, and wherein in an operating position of the device the unfolding of the laminar portion of each compartment takes place up to an end operating position in which each laminar portion is unfolded and the container is formed by two walls, each of a length equivalent to a sum of lengths of the outer wall and of the inner wall, and by the central space comprised between said two walls.

4. The device according to claim 3, wherein each compartment comprises in a corresponding space formed between the outer wall, the inner wall and the fold, a different liquid or pasty product which reacts when contacted with the product of the other compartment, causing the dyeing or bleaching of the locks selected by the comb inside the container.

5. The device according to claim 3, wherein the selector comb comprises a head formed by an essentially flat portion and provided at a free end of the selector comb with a set of teeth shaped like prongs and hooks, followed by an elongated part so that a user can pull on said elongated part to go from a non-operating position of the device in which the two compartments are folded to an operating position of the device in which the two compartments are unfolded to expose the portion of the locks to the liquid or pasty product.

6. The device according to claim 5, wherein in the non-operating position of the device, the essentially flat portion of the head of the selector comb comprises an attachment region extending along a width of the head and arranged a certain distance from the free end provided with the set of teeth, whereby the comb is coupled to each inner wall, opposite the fold of each compartment, the comb being arranged partially inside the central space of the container with at least an exception of the free end of the head provided with the set of teeth, which projects from the container in the non-operating position of the device, and wherein in an operating position of the device, including an end operating position, the free end of the head is located inside the central space of the container.

7. The device according to claim 6, wherein the inner wall of each compartment is provided with an adhesive strip, whereby the compartment is removably coupled and attached to the selector comb.

8. The device according to claim 5, comprising sealing and holding means coupled to the container, provided with two jaws suitable for the leak-tight closure of the container and suitable for removably fixing the device to a region of the portion of hair containing the locks, said region being located adjacent to the scalp, and wherein in the non-operating position of the device, the set of teeth of the free end of the head of the comb is located on an outside of the two jaws.

9. The device according to claim 8, wherein the sealing and holding means comprise closure means for facing arrangement of the two jaws, distal ends of the jaws facing one another and being configured for firmly grasping a region of the hair close to the scalp or any other element interposed between the two jaws, while at the same time providing the leak-tight closure of the container.

10. The device according to claim 8, wherein the outer wall of each compartment is provided with an adhesive strip, whereby the compartment is removably coupled and attached to at least one of the jaws.

11. The device according to claim 3, wherein each inner wall and each outer wall of each compartment comprises at least one inner face configured to come into contact with the liquid or pasty product both prior to and during operation of the device, and at least one outer face opposite the inner face, the inner face being made of an absorbent, non-woven fabric material and the outer face comprising an impermeable layer so that the product does not go through any of the walls forming the container.

12. The device according to claim 3 wherein at least one compartment comprises at least one liquid or pasty product for dyeing or bleaching hair in the space formed between the respective outer wall, the inner wall and the joint section of these walls along the fold and wherein side edges of each outer wall and side edges of each inner wall are provided with a pressure-sensitive adhesive for carrying out a removable side sealing in the container such that in the non-operating position, each of the compartments is laterally sealed as the side edges of the outer wall are removably attached with the respective side edges of the inner wall, said attachment being able to gradually come undone as the portion having a laminar structure of each compartment is gradually unfolded in the operating position; and as the laminar structure of each compartment is gradually unfolded and in the end operating position, the side edges of the outer wall and the side edges of the inner wall of a container can become attached with the side edges of the outer wall and the side edges of the inner wall of the other container, respectively.

13. A system for bleaching or dyeing a plurality of locks of hair comprising;

the device according to claim 8; and a supply of additional compartments, each additional compartment having a flattened structure arranged for use in the device, each additional compartment being formed by a structure having a laminar portion made of an absorbent, non-woven fabric material folded such that the additional compartment is formed by an outer wall and an inner wall facing one another and joined at least at a lower end by the fold, the inner wall and the outer wall being provided with respective adhesive strips at ends opposite the fold and configured for the removable coupling, respectively, to the selector comb of the device and to a jaw of a sealing and holding means provided in the device, the adhesive strips being covered by at least one protective layer that can be removed to uncover the adhesive surface, the side edges of the inner wall and of the outer wall being provided with a pressure-sensitive adhesive, and comprising a liquid or pasty product for dyeing or bleaching the locks in a space demarcated by the outer wall, the inner wall and the fold and which is released from the additional compartment when the laminar portion is unfolded.

14. A method for selectively bleaching or dyeing a plurality of locks of hair on a scalp by applying at least one liquid or pasty product, in which a portion of hair containing the locks to be treated is initially combed, separating the portion of hair from the rest of the hair, and the combed portion is held with one hand at an end opposite the scalp, wherein the method comprises the following steps:

a) grabbing with the other hand the device according to claim 8 with each compartment of the container provided with a liquid or pasty product for dyeing or bleaching hair;

b) sinking the set of teeth provided at the free end of the essentially flat portion of the head of the selector comb into the portion of hair that is tensed with the other hand, at a distance comprised between 1 and 5 cm from the scalp;

c) letting go of the portion of hair;

d) with the hand used in step a), holding the free end of the elongated part of the selector comb and pulling away from the scalp until the set of teeth of the head goes through the space between the two jaws and enters the container, at this point closing the jaws, being arranged facing one another such that the locks to be treated are grasped between the two jaws;

e) at the same time as the preceding step, bringing the sealing and holding means towards the scalp and closing the jaws so that the sealing and holding means are held firmly against the part adjacent to the scalp forming the beginning of the portion of hair comprising the locks to be treated, f) with the hand used in step d), continue pulling the free end of the elongated part in the same direction up to the end operating position of the device in which the flattened structure of the container is completely unfolded, a selection of locks of hair being dragged by the teeth shaped like hooks of the selector comb into the inner space of the container and in contact with the liquid or pasty product;

g) allowing the liquid or pasty product in contact with the selection of locks to act for a certain time until causing the dyeing or bleaching thereof; and h) opening the two jaws of the sealing and holding means until the two jaws are separated and releasing the device from the portion of hair.

15. The method according to claim 14, wherein between step f) and step g) the side edges of the unfolded inner wall and unfolded outer wall of one compartment are pressed against the side edges of the unfolded inner wall and unfolded outer wall of the other compartment for laterally sealing the container in the end operating position.

* * * * *